US011383528B2

(12) United States Patent
Yamada

(10) Patent No.: US 11,383,528 B2
(45) Date of Patent: Jul. 12, 2022

(54) LIQUID DISCHARGE APPARATUS

(71) Applicant: Ricoh Company, Ltd., Tokyo (JP)

(72) Inventor: Masafumi Yamada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 81 days.

(21) Appl. No.: 17/034,206

(22) Filed: Sep. 28, 2020

(65) Prior Publication Data

US 2021/0122171 A1 Apr. 29, 2021

(30) Foreign Application Priority Data

Oct. 28, 2019 (JP) ..... JP2019-195038
Sep. 15, 2020 (JP) ..... JP2020-154804

(51) Int. Cl.
*B41J 11/00* (2006.01)
*B41J 2/045* (2006.01)
*B41J 2/14* (2006.01)

(52) U.S. Cl.
CPC ..... *B41J 11/002* (2013.01); *B41J 2/04531* (2013.01); *B41J 2/14088* (2013.01)

(58) Field of Classification Search
CPC ..... B41J 11/002; B41J 11/00216; B41J 11/00222; B41J 11/0024; B41J 11/00244; B41J 2/04531; B41J 2/14088; B41J 2/04528; B41J 2/04596; B41J 2/04598; B41J 2/05; B41J 2/38
See application file for complete search history.

(56) References Cited

U.S. PATENT DOCUMENTS

| | | | |
|---|---|---|---|
| 9,327,524 | B1 | 5/2016 | Yamada et al. |
| 2006/0082612 | A1 | 4/2006 | Morikawa et al. |
| 2016/0114600 | A1 | 4/2016 | Yamada et al. |
| 2017/0266986 | A1 | 9/2017 | Yamada |
| 2018/0361634 | A1* | 12/2018 | Ushigome ..... B41M 5/0064 |
| 2019/0100032 | A1* | 4/2019 | Nakai ..... B41J 2/15 |
| 2019/0275812 | A1 | 9/2019 | Moriya et al. |

FOREIGN PATENT DOCUMENTS

| | | |
|---|---|---|
| JP | 8-146840 | 6/1996 |
| JP | 2013-039697 | 2/2013 |

* cited by examiner

*Primary Examiner* — Kristal Feggins
(74) *Attorney, Agent, or Firm* — Xsensus LLP

(57) ABSTRACT

A liquid discharge apparatus includes a heater configured to heat a medium, a detector configured to detect a temperature of the heater, a conveyor configured to convey the medium during a printing operation, and circuitry configured to control the heater to heat the medium with a first output during a preheating operation before the printing operation, control the heater to heat the medium with a second output that is equal to or higher than the first output when the temperature of the heater reaches a predetermined threshold value to complete the preheating operation, and control the conveyor to start conveying the medium to start the printing operation.

10 Claims, 4 Drawing Sheets

A: MAIN-SCANNING DIRECTION
B: DOWNSTREAM DIRECTION IN MAIN-SCANNING DIRECTION
C: UPSTREAM DIRECTION IN MAIN-SCANNING DIRECITON

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2019-195038, filed on Oct. 28, 2019, in the Japan Patent Office and Japanese Patent Application No. 2020-154804, filed on Sep. 15, 2020, in the Japan Patent Office, the entire disclosures of which are hereby incorporated by reference herein.

BACKGROUND

Technical Field

Aspects of the present disclosure relate to a liquid discharge apparatus.

Related Art

Various apparatuses control a preheating operation during a printing operation. For example, an image forming apparatus may be used as a plurality of image recording apparatuses such as a copier, a facsimile, and a printer.

The image forming apparatus includes a temperature detector and a controller of a heating element, a device to change a preheating temperature of the heating element, and a counter to count a number of image formation for each of the above-described functions in a predetermined time.

The image forming apparatus controls the preheating temperature of the heating element according to a counting result of the counter. Further, the controller of the heating element of the image forming apparatus has two states of a power saving state and a standby state. The controller of the heating element controls to switch between the two states of the power saving state and the standby state based on the counting result of the counter.

SUMMARY

In an aspect of this disclosure, a liquid discharge apparatus includes a heater configured to heat a medium, a detector configured to detect a temperature of the heater, a conveyor configured to convey the medium during a printing operation, and circuitry configured to control the heater to heat the medium with a first output during a preheating operation before the printing operation, control the heater to heat the medium with a second output that is equal to or higher than the first output when the temperature of the heater reaches a predetermined threshold value to complete the preheating operation, and control the conveyor to start conveying the medium to start the printing operation.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
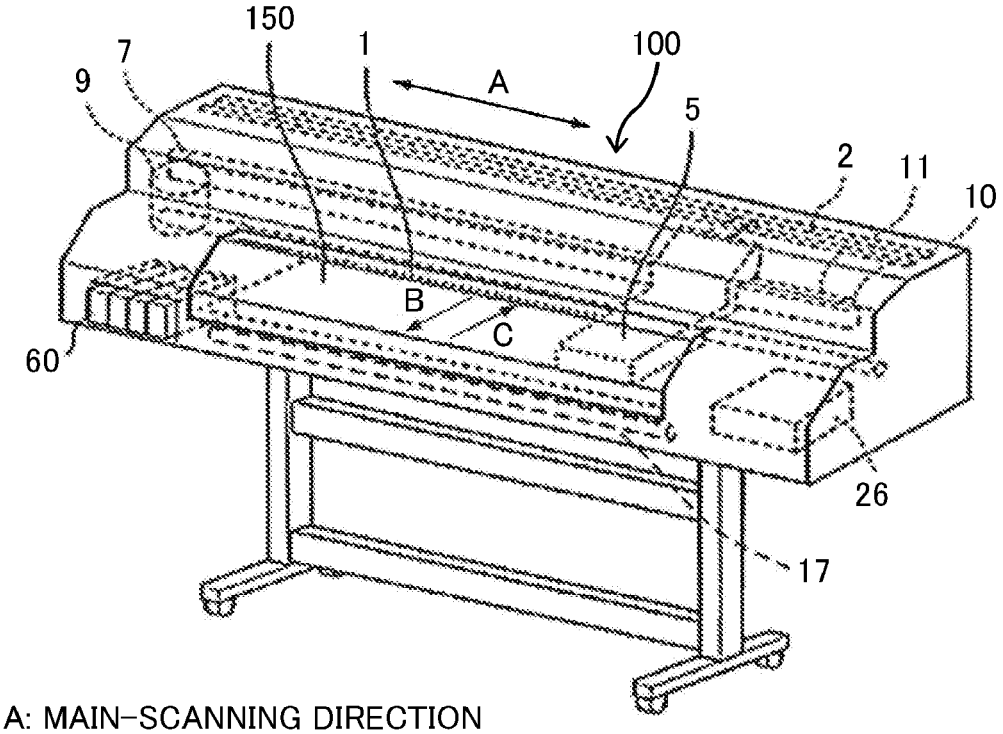
FIG. 1 are schematic perspective view of an inkjet recording apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Hereinafter, a liquid discharge apparatus according to an embodiment of the present disclosure is described with reference to the accompanying drawings. The liquid discharge apparatus according to an embodiment of the present disclosure has following features in a serial type inkjet recording apparatus using an infrared heater. That is, the liquid discharge apparatus controls to enter the preheating operation of the infrared heater before the printing operation is started when a print job is input to the liquid discharge apparatus.

Therefore, the liquid discharge apparatus can satisfy dry quality of image at a print start portion of a recording medium. Further, the liquid discharge apparatus controls the preheating operation so that the preheating temperature of the preheating operation is lower than a heating temperature during an actual printing operation. Thus, the preheating operation at the preheating temperature does not actually damage the recording medium.

Therefore, the liquid discharge apparatus can prevent damage on the recording medium such as deformation and melting of the recording medium due to the preheating operation. The liquid discharge apparatus thus controls the preheating operation to determine completion of the preheating operation at timing when an internal temperature of the infrared heater becomes equal to or higher than a predetermined threshold value. Then, the liquid discharge apparatus shifts from the preheating operation to the printing operation.

The above features of the embodiments of the present disclosure are described below in detail with reference to the following drawings.

Figure 2:
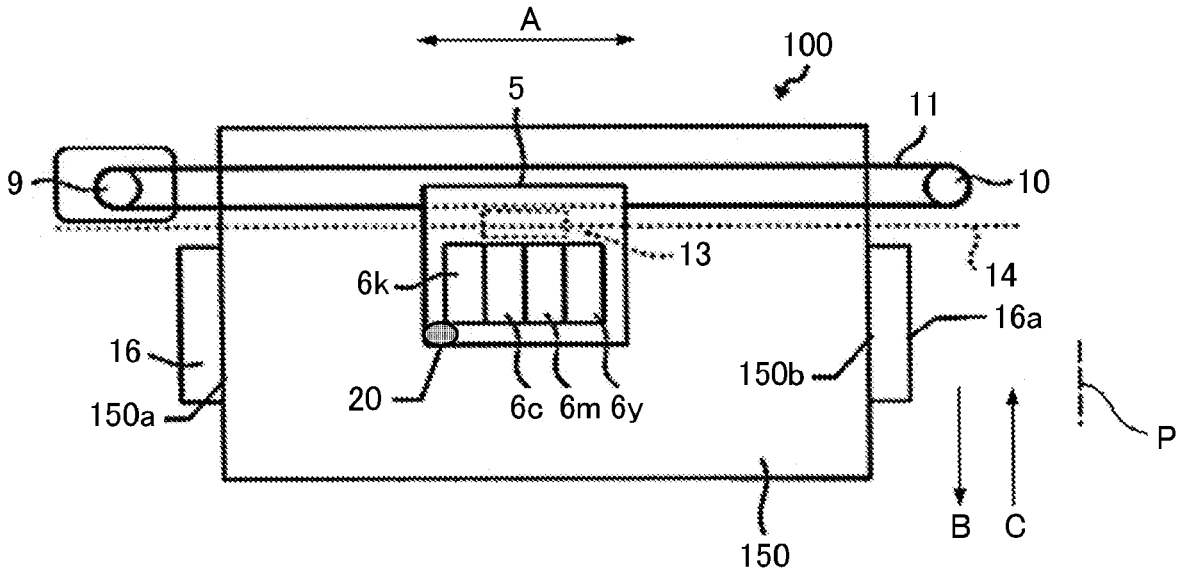
FIG. 2 is a schematic plan view of a carriage scanner of the inkjet recording apparatus of FIG. 1.

FIG. 1 are schematic perspective view of the inkjet recording apparatus 100 serving as the liquid discharge apparatus according to the embodiment of the present disclosure. FIG. 2 is a schematic plan view of a carriage scanner of the inkjet recording apparatus 100 of FIG. 1. As illustrated in FIGS. 1 and 2, the inkjet recording apparatus 100 includes a guide rod 1 and a sub-guide rail 2 bridged between both side plates of the inkjet recording apparatus 100. The inkjet recording apparatus 100 includes a carriage 5 held by the guide rod 1 and the sub-guide rail 2.

The carriage 5 is reciprocally movable in a main-scanning direction indicated by arrow "A." The carriage 5 is connected to a timing belt 11 wound around a drive pulley 7 and a pressure pulley 10 (see FIG. 2). The inkjet recording apparatus 100 includes a main-scanning motor 9 to move the timing belt 11 via the drive pulley 7 to reciprocally move the carriage 5 in the-main scanning direction A.

The pressure pulley 10 applies a tension to the timing belt 11 so that the carriage 5 can be driven without sagging. A "home position" indicated by a line "P" is set above a maintenance mechanism 26, for example. The home position is also simply referred to as "HP."

The recording medium 150 is intermittently conveyed in a sub-scanning direction indicated by arrow "B" below a scanning area of the carriage 5 in which the carriage 5 reciprocally moves.

The sub-scanning direction B is also referred to as a "conveyance direction" of the recording medium 150. The inkjet recording apparatus 100 includes recording heads 6 (6*k*, 6*c*, 6*m*, and 6*y*) mounted on the carriage 5. The recording heads 6 (6*k* to 6*y*) discharge ink as liquid droplets onto the recording medium 150 to form a predetermined image on the recording medium 150 on a platen 16. Hereinafter, the recording heads 6*k*, 6*c*, 6*m*, and 6*y* are simply referred to as the "heads 6."

Each of the heads 6 includes a plurality of nozzles to discharge ink from the plurality of nozzles. The recording medium 150, on which the image is formed, is dried by a dryer 17 that faces an ejection guide 32 (see FIG. 3). The dryer 17 includes a drying heater. The inkjet recording apparatus 100 includes a cartridge 60 and the maintenance mechanism 26. The cartridge 60 (see FIG. 1) supplies the ink to the heads 6 (see FIG. 3).

The maintenance mechanism 26 performs a maintenance operation on the heads 6 mounted on the carriage 5. The inkjet recording apparatus 100 includes a main-scanning encoder sensor 13 in the carriage 5. Hereinafter, the main-scanning encoder sensor 13 is simply referred to as an "encoder sensor 13."

The encoder sensor 13 sequentially reads an encoder sheet 14 bridged between the both side plates. The inkjet recording apparatus 100 thus drives the carriage 5 between two side plates while detecting a position of the carriage 5 in the main-scanning direction A.

Further, the inkjet recording apparatus 100 includes a medium detection sensor 20 attached to the carriage 5. The medium detection sensor 20 is, for example, a reflection type sensor. The medium detection sensor 20 includes a light emitting diode (LED) to emits light on the recording medium 150 and detects a reflected light reflected from the recording medium 150 to detect presence or absence of an object (recording medium 150) that faces the medium detection sensor 20.

The inkjet recording apparatus 100 according to the embodiment of the present disclosure recognizes an exterior area of the platen 16 (area outside a right end 16*a* of the platen 16, for example), an upper area of the platen 16, and an upper area of the recording medium 150 (area between a left end 150*a* and a right end 150*b* of the recording medium 150) according to a value of the reflected light. The "exterior area of the platen 16" is an area immediately below the carriage 5 and is also referred to as a "platen outer area." The upper area of the platen 16 is also referred to as a "platen upper area." The upper area of the recording medium 150 is also referred to as a "medium upper area."

Figure 3:
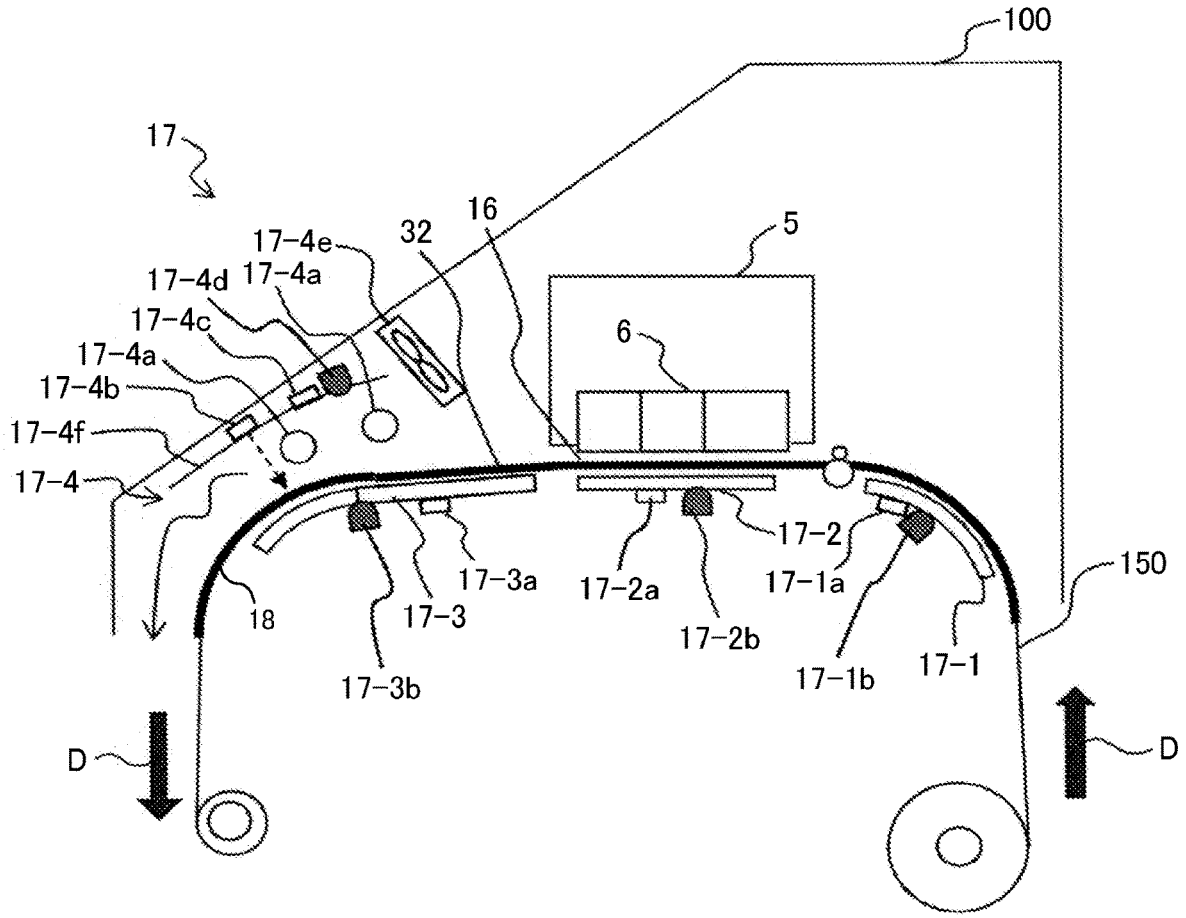
FIG. 3 is a cross-sectional side view of the inkjet recording apparatus including a dryer illustrated in FIG. 1.

FIG. 3 is a cross-sectional side view of the inkjet recording apparatus 100 including the dryer 17 illustrated in FIG. 1. A left side of the inkjet recording apparatus 100 in FIG. 3 corresponds to a front side of the inkjet recording apparatus 100 as illustrated in FIG. 1. The recording medium 150 is conveyed from a right side to the left side in the conveyance direction of the recording medium 150 as indicated by arrow "D". Hereinafter, the conveyance direction of the recording medium 150 is simply referred to as a "conveyance direction D."

Further, the conveyance direction D is identical with the "sub-scanning direction B" in FIG. 1. The inkjet recording apparatus 100 includes four heaters, a preheater 17-1, a print heater 17-2, a post heater 17-3, and an infrared heater 17-4 in an order from the right side (upstream side) to the left side (downstream side) in the conveyance direction D on a conveyance path of the recording medium 150.

The preheater 17-1 is also referred to as a "first heater". The infrared heater 17-4 is also referred to as a "second heater." The preheater 17-1 contacts the recording medium 150 to heat the recording medium 150. The infrared heater 7-4 heats the recording medium 150 without contacting the recording medium 150 (in a non-contact manner).

The preheater 17-1 heats the recording medium 150 at a preheating area upstream of a printing area in the conveyance direction D before the recording medium 150 is conveyed to the printing area at which the recording medium 150 faces the head 6. The preheater 17-1 heats the recording medium 150 from a back side (lower side) of the recording medium 150 conveyed in the conveyance direction D to the preheating area. The preheater 17-1 gradually heats the recording medium 150 from a downstream side of the recording medium according to a conveyance of the recording medium 150 in the conveyance direction D.

Thus, the ink discharged from the heads 6 and landed onto the recording medium 150 easily evaporates by heat applied on the recording medium 150 by the preheater 17-1 (preheating operation). The print heater 17-2 heats the recording medium 150 onto which an image is formed by the ink (liquid droplets) discharged from the heads 6. The print heater 17-2 heats the ink on the recording medium 150 to evaporate water content in the ink so that a dried ink surface forms a film (ink set) on the recording medium 150.

The ink surface is film-formed to form a membrane on the ink surface. The print heater 17-2 heats and dries the ink to extent so that the ink does not adhered to a hand even when the ink is touched with the hand. The film-forming of the ink is also referred to as an "ink set" because a spread and a size of ink droplets (dots) are determined at the time of film-forming.

The print heater 17-2 is the most important heater to form an image on the recording medium 150. The post heater 17-3 further heats the recording medium 150 at a post-heating area downstream of the print area in the conveyance direction D to evaporate the water content and solvent in the ink to dry the ink. The infrared heater 17-4 faces a front surface (upper surface) of the recording medium 150. The infrared heater 17-4 heats an ink surface from an interior of the ink by far infrared rays (IR). Thus, the infrared heater 17-4 causes a polymerization reaction in resin in the ink by the far infrared rays (IR) to cure the ink.

The preheater 17-1, the print heater 17-2, and the post heater 17-3 respectively include thermistors 17-1*a*, 17-2*a*, and 17-3*a* serving as temperature sensors (detectors) to respectively measure temperatures of conveyance surfaces of the preheating area, the print area, and the post-heating area of the conveyance path heated by the preheater 17-1, the print heater 17-2, and the post heater 17-3. The inkjet recording apparatus 100 controls the preheater 17-1, the print heater 17-2, and the post heater 17-3 according to a measurement results of the thermistors 17-1*a*, 17-2*a*, and 17-3*a* (temperature sensors) to control the temperature the conveyance surface of the preheating area, the print area, and the post-heating area in the conveyance path.

The thermistors 17-1*a*, 17-2*a*, and 17-3*a* are used as the temperature sensors (detectors) and are attached to the back side of a conveyance surface of the conveyance path. Further, the preheater 17-1, the print heater 17-2, and the post heater 17-3 respectively includes thermostats 17-1*b*, 17-2*b*, and 17-3*b*. The thermostats 17-1*b*, 17-2*b*, and 17-3*b* also serves as the detector in the embodiments of the present disclosure.

Thus, the thermostats 17-1*b*, 17-2*b*, and 17-3*b* are turned off when each of the preheater 17-1, the print heater 17-2, and the post heater 17-3 becomes out of control and cause an abnormal temperature rises. The preheater 17-1, the print heater 17-2, and the post heater 17-3 and the thermostats 17-1*b*, 17-2*b*, and 17-3*b* are electrically serially connected. When a power to the thermostat 17-1*b*, 17-2*b*, and 17-3*b* is cut off, the power supply to the preheater 17-1, the print heater 17-2, and the post heater 17-3 is also cut off to ensure the safety.

The infrared heater 17-4 includes at least one or more (two in FIG. 3) infrared heater 17-4*a*, a thermopile 17-4*b*, a thermistor 17-4*c*, a thermostat 17-4*d*, a curing fan 17-4*e*, and a reflection plate 17-4*f*. The infrared heater 17-4*a* is a heat source. The thermopile 17-4*b* is a non-contact temperature sensor that measures the surface temperature of the recording medium 150.

The thermistor 17-4*c* measures a temperature of the reflection plate 17-4*f* to measure a temperature inside the infrared heater 17-4. The thermostat 17-4*d* disconnects an electrical connection from the power source to the infrared heater 17-4 during abnormal heating to secure safety of the infrared heater 17-4. The curing fan 17-4*e* generates an air flow to control an increase in humidity near the recording medium 150 to accelerate drying of the ink on the recording medium 150.

The curing fan 17-4*e* further blows air to the infrared heater 17-4 to control overheating of the infrared heater 17-4. The reflection plate 17-4*f* reflects infrared rays emitted from the infrared heater 17-4*a* toward the recording medium 150 to accelerate heating of the recording medium 150. The infrared heater 17-4 includes a thermopile 17-4*b* to control temperature of the infrared heater 17-4. The thermopile 17-4*b* is a non-contact temperature sensor. The thermopile 17-4*b* measures temperature at a front surface (upper surface) of the recording medium 150.

The inkjet recording apparatus 100 controls an output of the infrared heater 17-4*a* so that the surface temperature of the recording medium 150 becomes a desired temperature. The thermistor 17-4*c*, as a second temperature sensor, is mounted on a reflection plate 17-4*f*. The thermistor 17-4*c* measures a temperature of the reflection plate 17-4*f*. The thermistor 17-4*c* monitors whether the temperature in the infrared heater 17-4 abnormally increases and determines whether the preheating operation is completed.

Figure 4:
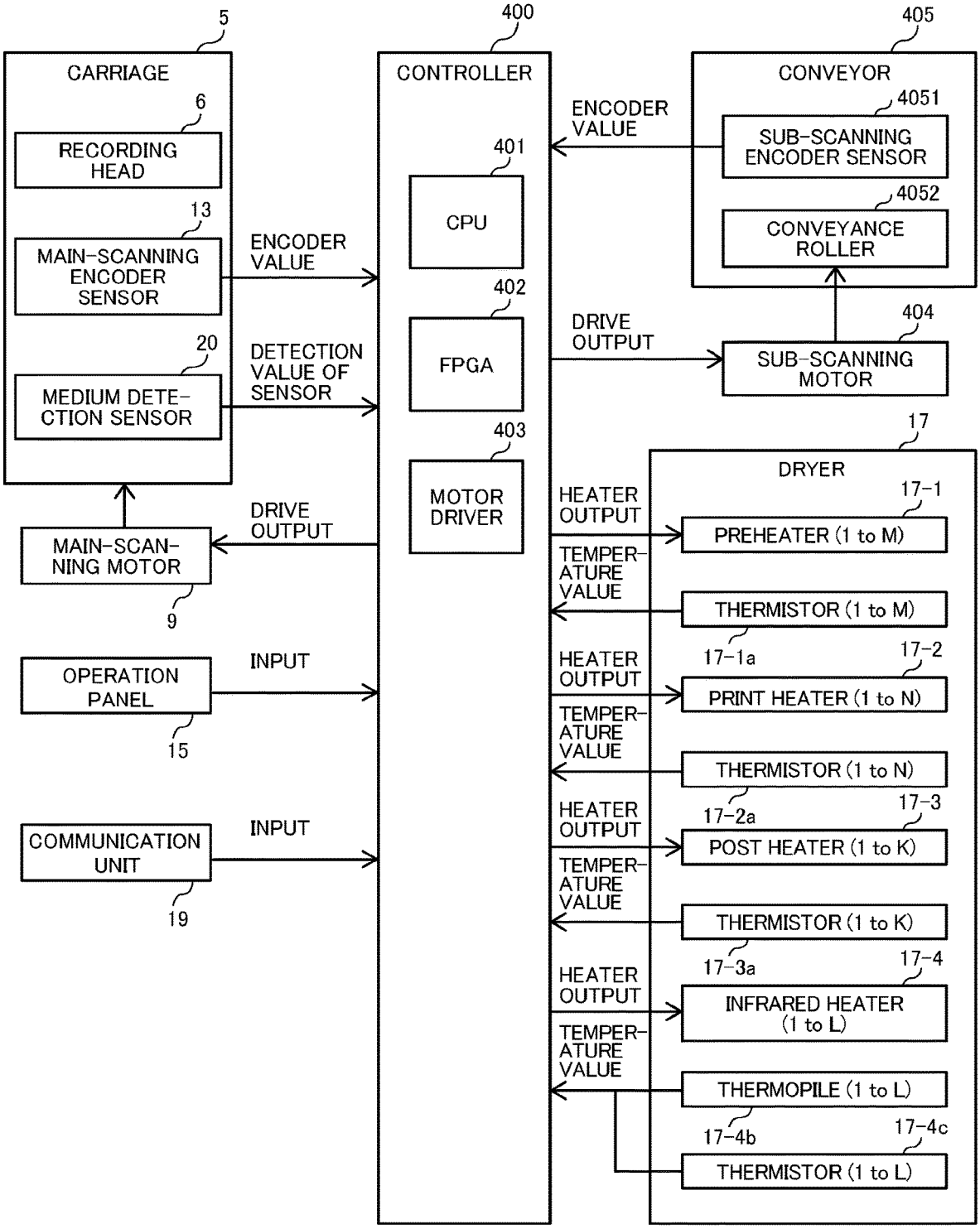
FIG. 4 is a block diagram illustrating a functional configuration of the inkjet recording apparatus according to the embodiment of the present disclosure.

FIG. 4 is a block diagram illustrating a functional configuration of the inkjet recording apparatus 100 according to the embodiment of the present disclosure. As illustrated in FIG. 4, the inkjet recording apparatus 100 includes a controller 400 (circuitry) to perform various controls in the inkjet recording apparatus 100 according to the embodiments of the present disclosure.

For example, the controller 400 includes a central processing unit (CPU) 401, a field-programmable gate array (FPGA) 402, and a motor driver 403. The CPU 401, the FPGA 402, and the motor driver 403 performs various controls performed by the inkjet recording apparatus 100 such as a CPU control, a memory control, an ink discharge control, a sensor control, and a motor control.

Further, as illustrated in FIGS. 1 and 2, the inkjet recording apparatus 100 includes the main-scanning motor 9, the carriage 5 driven by the main-scanning motor 9, the heads 6 (recording heads) mounted on the carriage 5, and the encoder sensor 13, and the medium detection sensor 20.

The encoder sensor 13 is also referred to as a "main-scanning encoder sensor." The inkjet recording apparatus 100 includes a sub-scanning motor 404 and a conveyor 405 to be driven by the sub-scanning motor 404. The conveyor 405 includes a sub-scanning encoder sensor 4051 and a conveyance roller 4052. The sub-scanning encoder sensor 4051 detects a conveyance amount of the recording medium 150 in the sub-scanning direction B (conveyance direction D). The conveyance roller 4052 conveys the recording medium 150 in the sub-scanning direction B (conveyance direction D).

Further, the inkjet recording apparatus 100 includes various mechanisms to be provided to an ordinary recording apparatus. Examples of the various mechanisms include a winding device including a winding motor, a winding roller, and a winding encoder sensor, a feeding device including a feed motor, and a feed roller, and a feed encoder sensor, for example. The dryer 17 includes the preheater 17-1, the print heater 17-2, the post heater 17-3, and the infrared heater 17-4. The dryer 17 includes "M" number of the preheaters 17-1 in which the preheater 17-1 is divided into M number in the sub-scanning direction B.

The dryer 17 includes "N" number of the print heaters 17-2 in which the print heater 17-2 is divided into N number in the main-scanning direction A. The dryer 17 includes "K" number of the post heaters 17-3 in which the post heater 17-3 is divided into K number in the main-scanning direction A and the sub-scanning direction B. The dryer 17 includes "L" number of the infrared heaters 17-4 in which the infrared heater 17-4 is divided into L number in the main-scanning direction A. The number of the infrared heater 17-4 may be one (L=1).

Further, the dryer 17 includes the temperature sensors to measure the temperatures of the preheaters 17-1, the print heaters 17-2, the post heaters 17-3, and the infrared heaters 17-4 divided into various number of M, N, L, and L, respectively. For example, the preheater 17-1 includes the thermistor 17-1*a* serving as the temperature sensor. The print heater 17-2 includes the thermistor 17-2*a* as the temperature sensor. The post heater 17-3 includes the thermistor 17-3*a* as the temperature sensor.

Further, the infrared heater 17-4 includes a thermistor 17-4*c* as the temperature sensor (second temperature sensor) and a thermopile 17-4*b* as the non-contact temperature sensor. The controller 400 controls each of an output of the preheater 17-1, the print heater 17-2, the post heater 17-3, and the infrared heater 17-4 so that each of the preheater 17-1, the print heater 17-2, the post heater 17-3, and the infrared heater 17-4 to reach a target temperature based on values of the above-described temperature sensors (the thermistors 17-1*a*, 17-2*a*, and 17-3*a*, the thermopile 17-4*b*, and the thermistor 17-4*c*).

Figure 5:
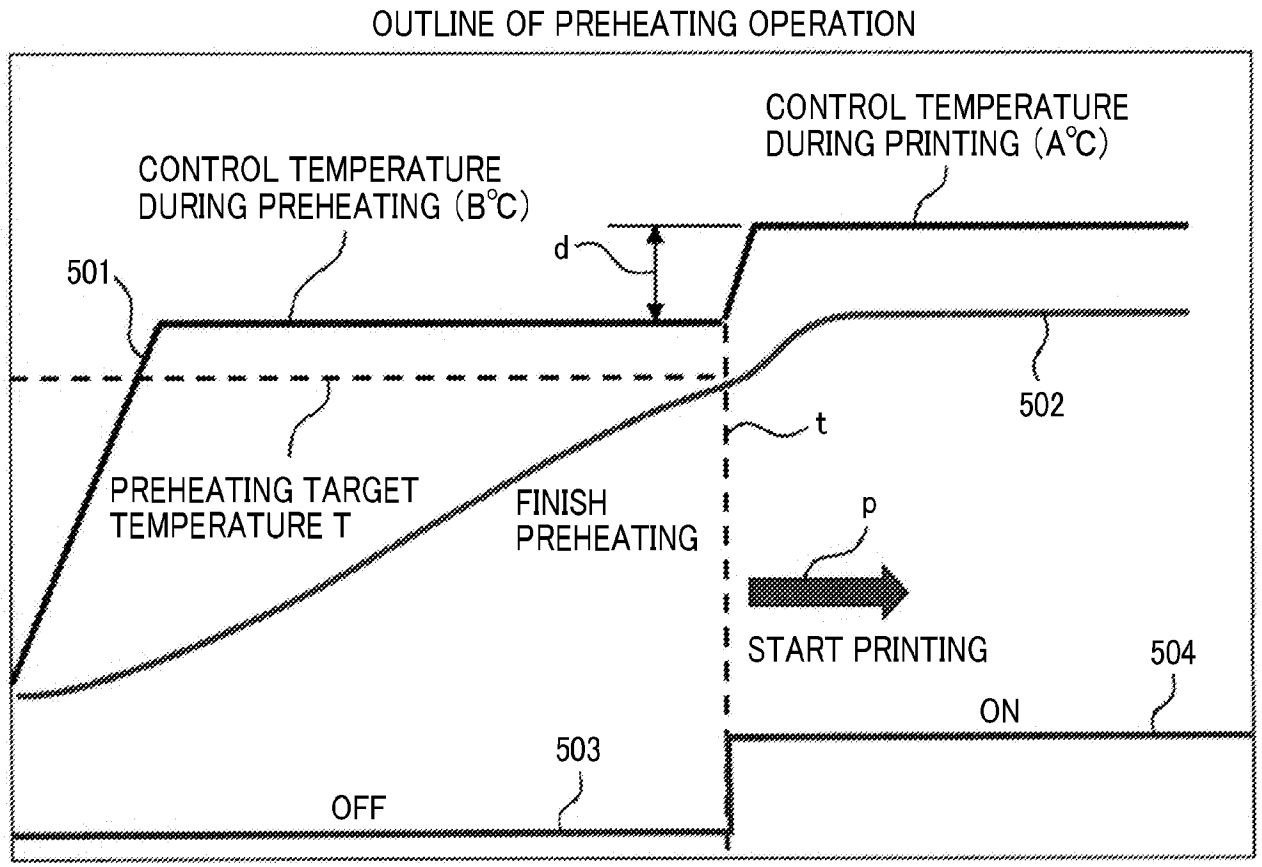
FIG. 5 is a graph illustrating a preheating operation performed in the inkjet recording apparatus according to the embodiment of the present disclosure.

FIG. 5 is a graph illustrating a preheating operation performed in the inkjet recording apparatus 100 according to the embodiment of the present disclosure. As illustrated in FIG. 5, each of the preheater 17-1, the print heater 17-2, the post heater 17-3, and the infrared heater 17-4 starts the preheating operation when the controller 400 determines that a print job is input to the controller 400. When the preheating operation is completed, the controller 400 starts conveyance of the recording medium 150 and the print operation.

The preheater 17-1, the print heater 17-2, and the post heater 17-3 are heaters that heats the recording medium 150 by a heat transferred from the back side (lower side in FIG. 3) of the recording medium 150 via a guide plate 18. The controller 400 completes the preheating operation when the temperature of each portions (the preheating area, the print area, and the post heating area) of the guide plate 18 monitored by each thermistor 17-1*a*, 17-2*a*, and 17-3*a*, the thermopile 17-4*b*, and the thermistor 17-4*c* reaches the target temperature.

The infrared heater 17-4 is not in direct contact with the recording medium 150. Thus, the controller 400 measures the surface temperature of the recording medium 150 with the thermopile 17-4*b* as the non-contact temperature sensor and monitors the surface temperature of the recording medium 150. The infrared heater 17-4*a* provided in the infrared heater 17-4 has a good temperature response to the recording medium 150.

Thus, the temperature of the recording medium 150 rises quickly even if the infrared heater 17-4*a* is not sufficiently warmed in a state in which the recording medium 150 is stopped. Therefore, if the controller 400 starts the printing operation because the surface temperature of the recording medium 150 reaches the target temperature, heat quantity of the infrared heater 17-4*a* cannot follow (reach) the target temperature when the recording medium 150 starts moving because the infrared heater 17-4*a* is not sufficiently warmed. Thus, it becomes difficult for the dryer 17 to maintain the temperature of the recording medium 150

From the above, it is not sufficient to measure only the surface temperature of the recording medium 150 by the thermopile 17-4*b* as a condition for completion of the preheating operation of the infrared heater 17-4. Therefore, the controller 400 measures the temperature of the thermistor 17-4*c* as the condition for completion of the preheating operation of the infrared heater 17-4. The thermistor 17-4*c* is the second temperature sensor that monitors the temperature of the reflection plate 17-4*f* in the infrared heater 17-4.

Thus, if the infrared heater 17-4*a* is sufficiently heated, the controller 400 can determine that the temperature of the thermistor 17-4*c* in the vicinity of the infrared heater 17-4*a* also exceeds a predetermined threshold value. Thus, the controller 400 appropriately sets the threshold value to satisfy the condition for completion of the preheating operation.

The preheating operation of the infrared heater 17-4 is described below with reference to FIG. 5. The controller 400 turns on the infrared heater 17-4*a* when the controller determines that the print job has been input to the controller 400. When the infrared heater 17-4*a* is turned on, the temperature of the surface of the recording medium 150 increases. The controller 400 controls the infrared heater 17-4*a* so that the detected temperature 501 of the thermopile 17-4*b* becomes a control temperature B ° C. during the preheating operation. The "control temperature during the preheating operation" is also referred to as a "control temperature during preheating (B ° C.)."

When the controller 400 determines that the temperature of the thermopile 17-4*b* has reached the control temperature during preheating (B ° C.), the detected temperature 502 of the thermistor 17-4*c* is lower than a preheating target temperature "T" and is in a state of gradually increasing. The preheating target temperature T is the predetermined threshold value as described above. The controller 400 continues the preheating operation while keeping the thermopile 17-4*b* at the control temperature during preheating (B ° C.) until the temperature of the thermistor 17-4*c* reaches the preheating target temperature T. Then, the controller 400 determines that the preheating operation is completed at timing "t" when the detected temperature 502 of the thermistor 17-4*c* exceeds the preheating target temperature T.

At the timing t, the controller 400 starts (enters) the printing operation P and conveys the recording medium when the detected temperature 502 of the thermistor 17-4*c* reaches the predetermined threshold value (preheating target temperature T) so that the controller 400 can determine that the preheating operation of the preheater 17-1, the print heater 17-2, and the post heater 17-3 have already been completed. The controller 400 controls the thermopile 17-4*b* so that the detected temperature 501 of the thermopile 17-4*b* becomes the control temperature (A ° C.) during the printing operation. The "control temperature during the printing operation" is also referred to as a "control temperature during printing (A ° C.)."

The control temperature during printing (A ° C.) is equal to or higher than the control temperature during preheating (A≥B). The control temperature during printing (A ° C.) is a temperature in which a predetermined difference temperature "d" is added to the control temperature during preheating (B ° C.). The controller 400 controls to maintain the temperature of the thermopile 17-4*b* to be the control temperature during preheating (B ° C.) until completion of the preheating operation and also after completion of the preheating when the controller 400 determines that the preheating operation of the preheater 17-1, the print heater 17-2, and the post heater 17-3 have not been completed.

The controller 400 sets the temperature of the thermopile 17-4*b* to the control temperature during printing (A ° C.) as the temperature needed to dry the ink on the recording medium 150. Since the control temperature during printing (A ° C.) has to be a high temperature to a degree, the control temperature during printing (A ° C.) is a temperature at which the recording medium 150 may be damaged or burnt.

However, if the recording medium 150 is conveyed, time taken for application of the control temperature during printing (A ° C.) on the recording medium 150 is limited. Thus, the recording medium 150 is not damaged by the control temperature during printing (A ° C.). Therefore, if the recording medium 150 is stopped (not conveyed) while the control temperature during printing (A ° C.) is applied to the recording medium 150, excessive heat quantity may be applied to the recording medium 150. Thus, a risk of damaging the recording medium 150 such as deformation or burnt of the recording medium 150 may occur.

Therefore, the controller 400 sets the temperature of the thermopile 17-4*b* to be the control temperature during printing (B ° C.) that does not damage the recording medium 150 even when the recording medium 150 is stopped (not conveyed). The controller 400 according to the embodiment of the present disclosure controls a temperature difference between the control temperature during printing (A ° C.) and the control temperature during preheating (B ° C.) to become the difference temperature d.

When the controller 400 determines that the recording medium 150 is not damaged (or the damage is less than a predetermined reference value) even when the recording medium 150 is stopped at the control temperature during printing (A ° C.), the controller 400 may set the control temperature during printing (A ° C.) and the control temperature during preheating (B ° C.) to the same temperature (d=0 and A=B).

The values of the control temperature during printing (A ° C.) and the control temperature during preheating (B ° C.) are different for each recording medium 150, for example, for each type of recording medium 150. For example, when the inkjet recording apparatus 100 prints on the recording medium 150 having different permeability, the controller 400 sets the temperature of the thermopile 17-4*b* to temperature higher than the control temperature during printing (A ° C.) because the recording medium 150 having low permeability needs more energy to be dried than the recording medium 150 having higher permeability.

The controller 400 changes the control temperature during preheating (B ° C.) according to a heat-resistant temperature of the recording medium 150. Thus, the controller 400 changes the temperature difference "d" between the control temperature during printing (A ° C.) and the control temperature during preheating (B ° C.) according to the types of the recording medium 150.

Therefore, the controller 400 stores a unique value of the control temperature during printing (A ° C.) and the control temperature during preheating (B ° C.) for each recording medium 150 in a storage medium such as a memory. Further, the controller 400 calls the above unique values from the storage medium such as the memory and executes the above-described control process.

For example, the controller 400 sets different values for the control temperature during printing (A ° C.) and the control temperature during preheating (B ° C.) for each type of the recording medium 150 made of polyvinyl chloride (PVC) and the recording medium 150 made of polyethylene terephthalate (PET) as illustrated in Table 1 below.

TABLE 1

| TYPES OF RECORDING MEDIUM | CONTROL TEMPERATURE "A" | CONTROL TEMPERATURE "B" | DETECTED TEMPERATURE 502 |
|---|---|---|---|
| PVC | 90 | 70 | 50 |
| PET | 70 | 60 | 50 |

In Table 1, the detected temperature 502 is a fixed value. However, the value of the detected temperature 502 may differ according to a difference in a position at which the control temperature during preheating (B ° C.) and the detected temperature 502 of the thermistor 17-4*c* are measured and design layout. In such a case, the controller 400 may set the value of the detected temperature 502 of the thermistor 17-4*c* within a range of approximately 50 to 100% with respect to the control temperature during preheating (B ° C.).

As illustrated in FIG. 5, the controller 400 may output a control signal 503 to stop operating (turns OFF) the curing fan 17-4*e* until the controller 400 determines that the preheating operation is completed to accelerate the preheating operation of the infrared heater 17-4. When the controller 400 determines that the preheating operation is completed, the controller 400 may output a control signal 504 to start operating (turning ON) the curing fan 17-4*e*. The controller 400 stops the curing fan 17-4*e* to prevent the infrared heater 17-4*a* and the reflection plate 17-4*f* from cooling and to quickly complete the preheating operation. Further, the controller 400 operates the curing fan 17-4*e* after completion of the preheating operation to prevent an interior of the infrared heater 17-4 from overheating.

Further, the inkjet recording apparatus 100 may include an operation panel 15 or a communication unit 19 so that the controller 400 can receive an operation related to the preheating operation such as a setting of preheating time from the user via the operation panel 15 or the communication unit 19. The communication unit 19 of the inkjet recording apparatus 100 is communicable with an operation terminal such as a smartphone via wireless communication. Thus, the operation panel 15 or the communication unit 19 receives the operation related to the preheating operation.

The controller 400 may execute the preheating operation of the inkjet recording apparatus 100 according to the operation received from the operation panel 15 or from the communication unit 19 via the wireless communication when the controller 400 determines that the operation is received from the operation panel 15 or the communication unit 19. The controller 400 performs such controls to set, change and delete the time of preheating operation by intention of the user.

Thus, the controller 400 can obtain balance between dry quality according to individual requirements of each user and damage to the recording medium 150. Further, the controller 400 may control a heating process of the recording medium 150 based on the control temperature during preheating (B ° C.) and the control temperature during printing (A ° C.) received from the user via the operation panel 15 according to the type of the recording medium 150 when the inkjet recording apparatus 100 includes the above-described operation panel.

The controller 400 thus can set above-described values according to a request from each user.

The inkjet recording apparatus 100 according to the embodiment of the present disclosure includes a serial-type inkjet printer for industrial use. The inkjet recording apparatus 100 performs dry control of media and ink. The inkjet recording apparatus 100 heats the recording medium 150 by a heater such as the infrared heater 17-4. The heater such as the infrared heater 17-4 heats the recording medium 150 with a first output such as the control temperature during preheating (B ° C.) before a start of the printing operation.

When the temperature of the heater (infrared heater 17-4, for example) reaches a predetermined threshold value (preheating target temperature T, for example), the controller 400 controls the heaters (infrared heater 17-4, for example) with a second output such as the control temperature during printing (A ° C.) that is higher than the first output such as the control temperature during preheating (B ° C.).

The inkjet recording apparatus 100 includes a controller such as the controller 400 including the CPU 401, the FPGA 402, and the motor driver 403, for example, to start conveyance of the recording medium 150 by the conveyor 405, for example. Thus, the controller 400 of the inkjet recording apparatus 100 can control the preheating operation while avoiding damage to the recording medium 150 and improving the image quality. Specifically, the controller 400 can soften a sudden temperature change on the recording medium 150, reduce deformation and cockling of the recording medium 150, and reduce an occurrence of jam.

The heater includes the infrared heater 17-4*a*, a first temperature sensor (thermopile 17-4*b*, for example) that detects a surface temperature of the recording medium 150, and a second temperature sensor (thermistor 17-4*c*, for example) that detects an inner temperature of the infrared heater 17-4. The controller 400 continuously output the first output until the first temperature sensor (thermopile 17-4*b*, for example) detects the first temperature that is the control temperature during preheating (B ° C.).

When the second temperature sensor (thermistor 17-4*c*) detects that the inner temperature of the infrared heater 17-4 becomes (reaches) the predetermined threshold value (preheating target temperature T), the controller 400 changes the output of the infrared heater 17-4 from the first output (B ° C.) to the second output (A ° C.). Therefore, the serial-type inkjet recording apparatus 100 using the heater to dry the ink on the recording medium 150 can satisfy dry quality even for the image at the print start portion on the recording medium 150 and prevent defects such as medium deformation and melting.

Further, the controller 400 performs a heating with the first output and a heating with the second output according to the type of the recording medium 150. Thus, the controller 400 sets the unique value according to the type of each recording medium 150 to ensure the dry quality regardless of the type of the recording medium 150 used and avoid the damage to the recording medium 150.

Further, the heater (infrared heater 17-4, for example) includes a fan (curing fan 17-4*e*, for example) to control the heating process of the heaters. The controller 400 stops the fan (curing fan 17-4*e*) until the temperature of the heater (infrared heater 17-4) reaches the predetermined threshold value (preheating target temperature T). The controller 400 then operates the fan (curing fan 17-4*e*) after the temperature of the heater (infrared heater 17-4) reaches a predetermined threshold value (preheating target temperature T).

Therefore, the inkjet recording apparatus 100 can prevent cooling of a portion, at which the infrared heater 17-4 and the second temperature sensor (thermistor 17-4*c*) are disposed, and quickly complete the preheating operation.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the controller 400 (circuitry) as described above may be implemented by one or more processing circuits or circuitry.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a heater configured to heat a medium, the heater including a second heater to heat the medium in a non-contact manner, the second heater further including a first temperature sensor to detect a surface temperature of the medium and a second temperature sensor to detect an inner temperature of the second heater;

a conveyor configured to convey the medium during a printing operation; and circuitry configured to:

control the second heater to heat the medium with a first output during a preheating operation before the printing operation;

determine that both the surface temperature of the medium detected by the first temperature sensor reaches a first temperature and the inner temperature of the second heater detected by the second temperature sensor reaches a predetermined threshold value higher than the first temperature to complete the preheating operation;

control the second heater to heat the medium with a second output that is equal to or higher than the first output; and control the conveyor to start conveying the medium to start the printing operation after completion of the preheating operation.

2. The liquid discharge apparatus according to claim 1, wherein the heater further includes:

a first heater configured to contact the medium to heat the medium.

3. The liquid discharge apparatus according to claim 2, wherein the first heater heats the medium from a back side of the medium.

4. The liquid discharge apparatus according to claim 3, wherein the second heater heats the medium from a front side of the medium.

5. The liquid discharge apparatus according to claim 2, wherein the second heater is an infrared heater.

6. The liquid discharge apparatus according to claim 1, wherein the circuitry is further configured to:

set the predetermined threshold value to be within a range of 50 to 100% with respect to the first temperature.

7. The liquid discharge apparatus according to claim 1, wherein the circuitry is further configured to control the heater to heat the medium with one of the first output and the second output according to a type of the medium.

8. The liquid discharge apparatus according to claim 1, wherein the heater further includes a fan configured to blow air to the heater, and the circuitry is further configured to:

stop operating the fan until the temperature of the second heater reaches the predetermined threshold value; and start operating the fan after the temperature of the second heater reaches the predetermined threshold value.

9. The liquid discharge apparatus according to claim 1, further comprising:

an operation panel configured to receive an operation related to the preheating operation, wherein the circuitry is further configured to control the heater to perform the preheating operation when the operation panel receives the operation related to the preheating operation.

10. The liquid discharge apparatus according to claim 1, further comprising:

a communication unit configured to receive an operation related to the preheating operation via wireless communication, wherein the circuitry is further configured to control the heater to perform the preheating operation when the communication unit receives the operation related to the preheating operation.

* * * * *